US010280544B2

(12) United States Patent
Alexander et al.

(10) Patent No.: US 10,280,544 B2
(45) Date of Patent: May 7, 2019

(54) FABRIC TREATING APPLIANCE

(71) Applicant: WHIRLPOOL CORPORATION, Benton Harbor, MI (US)

(72) Inventors: Benjamin E. Alexander, Stevensville, MI (US); Brent M. Burgess, Edwardsburg, MI (US); Michael K. Cluskey, Saint Joseph, MI (US); Christopher A. Jones, Saint Joseph, MI (US); Dale E. Mueller, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 393 days.

(21) Appl. No.: 14/803,424

(22) Filed: Jul. 20, 2015

(65) Prior Publication Data

US 2017/0022647 A1 Jan. 26, 2017

(51) Int. Cl.

| | |
|---|---|
| ***D06F 23/04*** | (2006.01) |
| ***D06F 21/08*** | (2006.01) |
| ***D06F 39/08*** | (2006.01) |

(52) U.S. Cl.

CPC ..... *D06F 23/04* (2013.01); *D06F 21/08* (2013.01); *D06F 39/083* (2013.01)

(58) Field of Classification Search

CPC ..... D06F 23/04; D06F 39/083; D06F 21/08; D06F 37/12; D06F 39/10

USPC ... 68/23 R, 208, 18 F, 23.5, 23.3, 23.4, 174; 210/380.1, 380.2, 360.1

See application file for complete search history.

(56) References Cited

U.S. PATENT DOCUMENTS

| | | | | | |
|---|---|---|---|---|---|
| 2,470,140 | A | * | 5/1949 | Castner | D06F 37/12 210/380.2 |
| 2,534,194 | A | * | 12/1950 | Emmert | D06F 37/245 210/365 |
| 2,575,691 | A | | 11/1951 | Smith | |
| 2,637,187 | A | * | 5/1953 | Smith | D06F 13/02 210/382 |
| 2,637,188 | A | * | 5/1953 | Smith | D06F 13/02 210/363 |
| 2,641,918 | A | * | 6/1953 | Smith | D06F 33/02 210/127 |
| 2,656,700 | A | * | 10/1953 | Smith | D06F 13/02 137/56 |
| 2,711,827 | A | * | 6/1955 | Smith | D06F 37/12 137/47 |
| 2,854,144 | A | | 9/1958 | Smith | |
| 2,872,801 | A | * | 2/1959 | Smith | D06F 13/00 210/363 |

(Continued)

FOREIGN PATENT DOCUMENTS

| | | |
|---|---|---|
| GB | 739666 | 11/1955 |

*Primary Examiner* — David G Cormier
*Assistant Examiner* — Thomas Bucci
(74) *Attorney, Agent, or Firm* — McGarry Bair PC

(57) ABSTRACT

A fabric treating appliance includes a rotatable basket defining a treating chamber for receiving a load of laundry items for treatment. The basket comprises a dual wall, having an inner wall and an outer wall, defining a space therebetween. Liquid within the treating chamber can flow through a plurality of liquid extraction perforations and into the space between the walls, where the liquid can drain downwardly out through an opening in the outer wall and into a tub.

12 Claims, 7 Drawing Sheets

(56) References Cited

U.S. PATENT DOCUMENTS

| | | | | | |
|---|---|---|---|---|---|
| 3,948,064 | A * | 4/1976 | Sauer | D06F 23/04 | 68/23.4 |
| 4,359,146 | A * | 11/1982 | Davis | B04B 7/06 | 192/136 |
| 5,353,612 | A * | 10/1994 | Noguchi | D06F 33/02 | 68/12.02 |
| 5,727,402 | A * | 3/1998 | Wada | D06F 35/006 | 68/207 |
| 2008/0141466 | A1* | 6/2008 | Leidig | D06F 37/225 | 8/159 |
| 2011/0005277 | A1* | 1/2011 | Hasanreisoglu | D06F 37/065 | 68/12.06 |
| 2011/0148260 | A1* | 6/2011 | Silva | D06F 23/04 | 312/228 |
| 2011/0247373 | A1* | 10/2011 | Sharp | D06F 23/04 | 68/131 |
| 2013/0036774 | A1* | 2/2013 | Kim | D06F 37/26 | 68/142 |
| 2013/0036776 | A1* | 2/2013 | Seo | D06F 23/04 | 68/18 F |

* cited by examiner

FABRIC TREATING APPLIANCE

BACKGROUND

Fabric treating appliances, such as washing machines, clothes dryers, refreshers, and non-aqueous systems, can have a configuration based on a rotating container that at least partially defines a treating chamber in which laundry items are placed for treating. Traditionally, in a vertical axis washing machine, the container is a perforated basket, which is located within an imperforate tub, with both the basket and tub typically have an upper opening at their respective upper ends. The tub surrounds the basket and generally has a height as tall as or taller than the basket to catch water exiting the perforations of the basket for the full height of the basket.

During a wash or rinse cycle, to fill the basket to a predetermined level with liquid, the liquid must also fill the space between the basket and the tub, which is more liquid than necessary for the treatment of the laundry within the basket. The additional liquid needed to fill the space between the basket and the tub can result in a waste of water.

During a spin cycle, the basket is spun and the liquid escapes from the basket through the perforations, where the escaping liquid is captured by the tub. The volume of the basket, and therefore the amount of laundry capable of treatment in a load, is limited by the size of the tub for a traditional fabric treating appliance.

BRIEF SUMMARY

A fabric treating appliance for treating laundry according to a cycle of operation includes a tub having a tub end and a tub peripheral wall extending from the tub, with the tub end and the tub peripheral wall defining a tub interior. The tub peripheral wall terminates at a tub terminal edge to define a tub access opening providing access to the tub interior. A basket having a basket end and a basket peripheral wall extending from the basket, with the basket end and the basket peripheral wall defining a basket interior form at least part of a laundry treating chamber. The basket peripheral wall terminates at a basket terminal edge to define a basket access opening providing access to the basket interior. At least a portion of the basket extends into the tub interior. A motor operably couples to the basket and rotates the basket relative to the tub about a basket axis of rotation. The basket peripheral wall comprises an inner wall and an outer wall. The inner wall comprises a plurality of liquid extraction perforations, with at least some of the liquid extraction perforations located exterior of the tub interior. The outer wall is imperforate opposite of the exterior of the liquid extraction perforations, and has a drain for emptying into the tub. Liquid can be extracted from the laundry within the basket interior by rotating the basket to an extraction speed where the liquid passes through the liquid extraction perforations, contacts the outer wall, and flows out the drain.

A fabric treating appliance for treating laundry according to a cycle of operations comprises a vertically oriented tub defining a tub interior and terminating in an upper edge to define a tub access opening providing access to the tub interior. A vertically oriented basket has a peripheral wall comprising an inner wall and an outer wall. The inner wall comprises a plurality of liquid extraction perforations, with at least some of the liquid extraction perforations located exterior of the tub interior. The outer wall is imperforate opposite of the exterior of the liquid extraction perforations, and has a drain for emptying into the tub interior. Liquid can be extracted from laundry within the basket interior by rotating the basket about a vertical axis to an extraction speed where the liquid radially passes through the liquid extraction perforations, contacts the outer wall, and flows downwardly out the drain.

DETAILED DESCRIPTION

Figure 1:
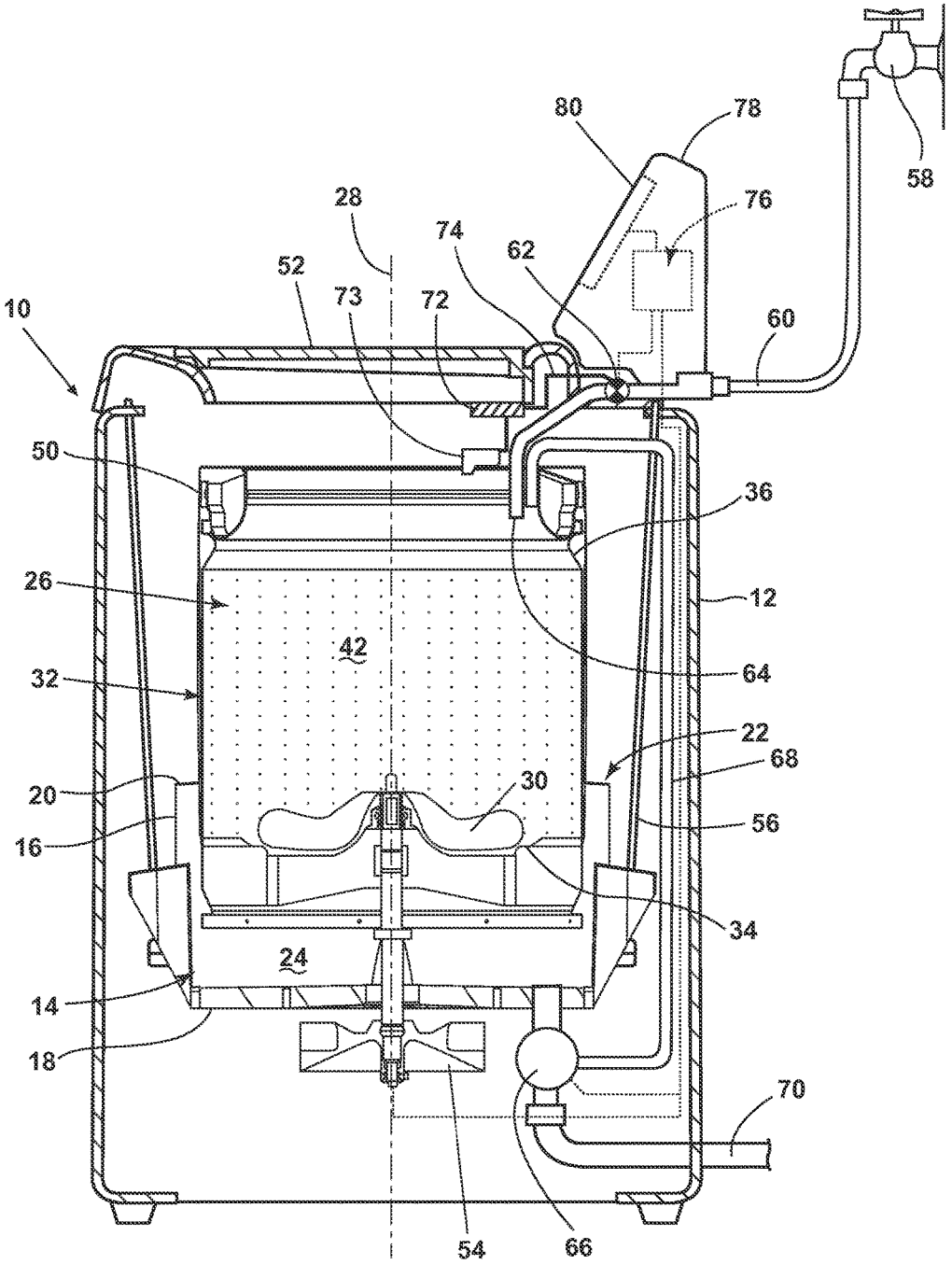
FIG. 1 illustrates a schematic, sectional view of a fabric treating appliance in the form of a washing machine having a double-wall basket according to an embodiment of the invention.

FIG. 1 is a schematic sectional view of a fabric treating appliance shown in the form of a washing machine 10 according to one embodiment of the invention. While the fabric treating appliance is illustrated as a vertical axis, top-fill washing machine, the embodiments of the invention can have applicability in other fabric treating appliances, non-limiting examples of which include a combination washing machine and dryer, a refreshing/revitalizing machine, an extractor, or a non-aqueous washing apparatus.

The washing machine 10 can include a structural support system comprising a cabinet 12 that defines a housing within which a laundry holding system resides. The cabinet 12 can be a housing having a chassis and/or a frame, defining an interior that receives components typically found in a conventional washing machine, such as motors, pumps, fluid lines, controls, sensors, transducers, and the like. Such components will not be described further herein except as necessary for a complete understanding of the invention.

The fabric treating appliance of the illustrated exemplary washing machine 10 can include a tub 14 installed in the cabinet 12. The tub 14 can have a generally cylindrical side or tub peripheral wall 16 closed at its bottom by a tub end 18 that can at least partially define a sump. A tub terminal edge 20 of the tub peripheral wall 16 can define a tub access opening 22 to a tub interior 24 of the tub 14 for holding or receiving liquid. As can be appreciated, the tub peripheral wall 16 can be of a varying height, sufficient hold an amount of draining liquid without spilling over the tub terminal edge 20.

A basket 26 can be located within the cabinet such that a portion extends through the tub access opening 22 and resides within the tub interior 24. The basket is mounted relative to the tub 14 for rotation about a basket axis of rotation 28, such as, for example, a central, vertical axis extending through the center of the basket 26. The basket 26 can have a generally cylindrical side or peripheral wall 32 closed at the basket end by a basket bottom 34, defining a laundry treating chamber 42. A laundry mover 30, which is illustrated as an impeller, is located within the basket 26. Other exemplary types of laundry movers include, but are not limited to, an agitator, a wobble plate, and a hybrid impeller/agitator.

A balance ring 50 is disposed at the top of basket 26 to counterbalance a load imbalance that can occur within the treating chamber 42 during a cycle of operation. The illustrated balance ring 50 is provided at a terminal edge 36 of the basket 26. The top of the cabinet 12 can include a selectively openable lid 52 to provide access into the laundry treating chamber 42 through an open top of the basket 26.

A drive system including a drive motor 54, which can include a gear case, can be utilized to rotate the basket 26 and the laundry mover 30. The motor 54 can rotate the basket 26 at various speeds, including at a spin speed wherein a centrifugal force at the inner surface of the inner wall 44 is 1 g or greater; spin speeds are commonly known for use in extracting liquid from the laundry items in the basket 26, such as after a wash or rinse step in a treating cycle of operation. The motor 54 can also oscillate, reciprocate, or rotate the laundry mover 30 and the basket axis of rotation 28 during a cycle of operation in order to provide movement to the load contained within the laundry treating chamber 42. A clutch, not shown, can be provided and used in its traditional manner to permit oscillation of the clothes mover through a predetermined rotational angle while permitting spinning of the basket in one rotational direction.

A suspension system 56 can dynamically hold the tub 14 within the cabinet 12. The suspension system 56 can dissipate a determined degree of vibratory energy generated by the rotation of the basket 26 and/or the laundry mover 30 during a treating cycle of operation. Together, the tub 14, the basket 26, and any contents of the basket 26, such as liquid and laundry items, define a suspended mass for the suspension system 56.

The washing machine 10 can be fluidly connected to a liquid supply 58 through a liquid supply system including a liquid supply conduit 60 having a valve assembly 62 that can be operated to selectively deliver liquid, such as water, to the tub 14 or basket 26 through a liquid supply outlet 64, which is shown by example as being positioned at one side of the tub 14. The liquid supply 58 can be a household water source.

The washing machine 10 can further include a recirculation and drain system having a pump assembly 66 that can pump liquid from the tub 14 through a recirculation conduit 68 for recirculation of the liquid back into the basket 26 or tub 14, and/or to a drain conduit 70 to drain the liquid from the washing machine 10.

The washing machine 10 can also be provided with a dispensing system for dispensing treating chemistry to the basket 26, either directly or mixed with water from the liquid supply system, for use in treating the laundry according to a cycle of operation. The dispensing system can include a dispenser 72, which can be a single use dispenser, a bulk dispenser, or a combination of a single use and bulk dispenser. The dispenser 72 fluidly couples to a dispenser outlet 73 where treating chemistry can be supplied to the basket 26. Water can be supplied to the dispenser 72 from the liquid supply conduit 60 by directing the valve assembly 62 to direct the flow of water to the dispenser 72 through a dispensing supply conduit 74. In this case, the valve assembly 62 can be a diverter valve having multiple outlets such that the diverter valve can selectively direct a flow of liquid to one or both of the liquid supply outlet 64 and the dispensing supply conduit 74 and into the treating chamber 42.

It is noted that the illustrated drive system, suspension system, liquid supply system, recirculation and drain system, and dispensing system are shown for exemplary purposes only and are not limited to the systems shown in the drawings and described above. For example, the liquid supply, dispensing, and recirculation and pump systems can differ from the configuration shown in FIG. 1, such as by inclusion of other valves, conduits, treating chemistry dispensers, sensors (such as water level sensors and temperature sensors), and the like, to control the flow of liquid through the washing machine 10 and for the introduction of more than one type of treating chemistry. For example, the liquid supply system and/or the dispensing system can be configured to supply liquid into the interior of the tub 14 not occupied by the basket 26 such that liquid can be supplied directly to the tub 14 without having to travel through the basket 26. In another example, the liquid supply system can include separate valves for controlling the flow of hot and cold water from the household water source. In another example, the recirculation and pump system can include two separate pumps for recirculation and draining, instead of the single pump as previously described.

The washing machine 10 can also be provided with a heating system (not shown) to heat liquid provided to the treating chamber 42. In one example, the heating system can include a heating element provided in the sump to heat liquid that collects in the sump. Alternatively, the heating system can be in the form of an in-line heater that heats the liquid as it flows through the liquid supply, dispensing and/or recirculation systems.

The washing machine 10 can further include a control system for controlling the operation of the washing machine 10 to implement one or more treating cycles of operation. The control system can include a controller 76 located within a console 78 on top of the cabinet 12, or elsewhere, such as within the cabinet 12, and a user interface 80 that is operably coupled with the controller 76. The user interface 80 can include one or more knobs, dials, switches, displays, touch screens and the like for communicating with the user, such as to receive input and provide output. The user can enter different types of information including, without limitation, cycle selection and cycle parameters, such as cycle options.

The controller 76 can include the machine controller and any additional controllers provided for controlling any of the components of the washing machine 10. For example, the controller 76 can include a machine controller and a motor controller. Many known types of controllers can be used for the controller 76. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the washing machine 10.

Figure 2:
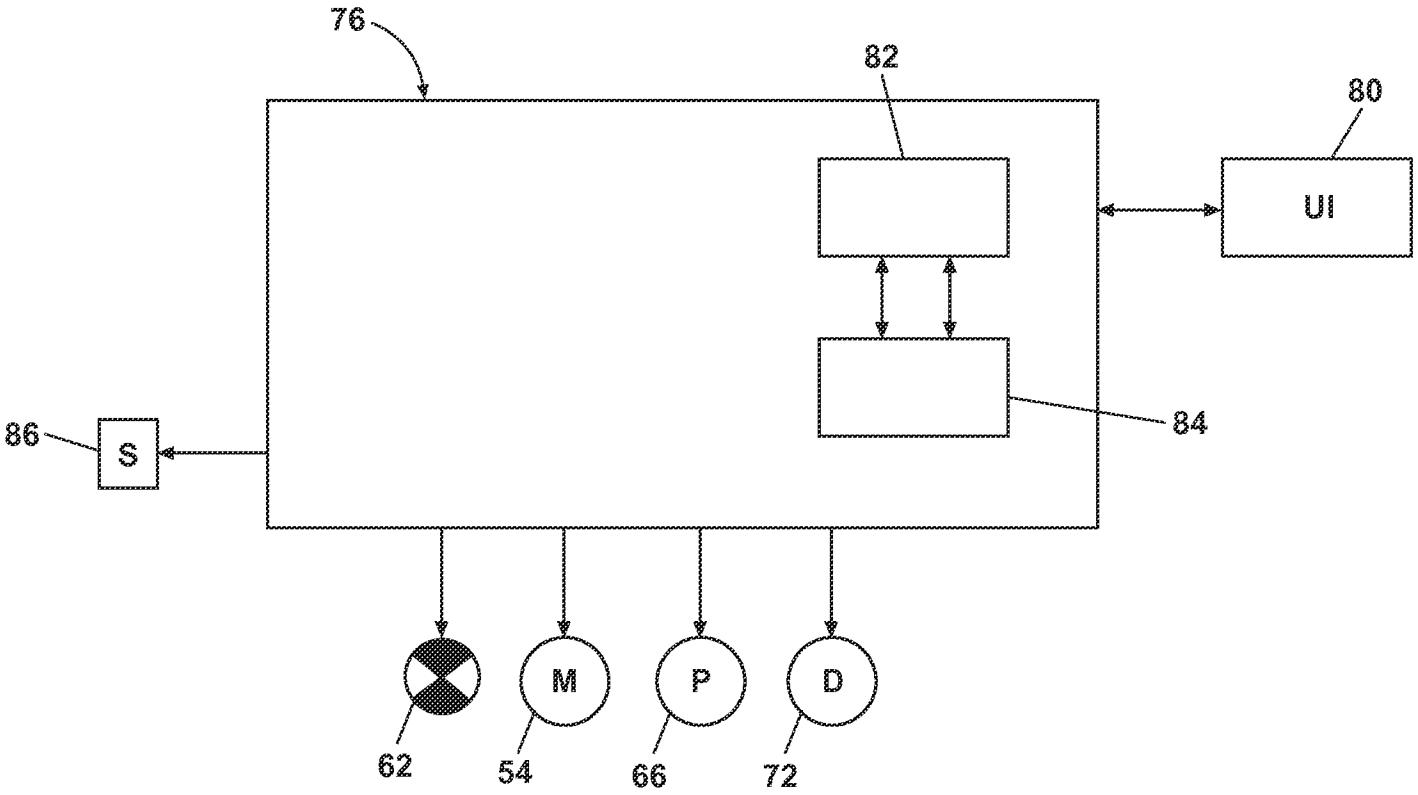
FIG. 2 illustrates a schematic view of a control system of the fabric treating appliance of FIG. 1.

FIG. 2 is a schematic view of an exemplary control system of the washing machine 10. The controller 76 can be provided with a memory 82 and a central processing unit (CPU) 84. The memory 82 can be used for storing the control software that is executed by the CPU 84 in completing a treating cycle of operation using the washing machine 10 and any additional software. Examples, without limitation, of treating cycles of operation include: wash, heavy duty wash, delicate wash, quick wash, pre-wash, refresh, rinse only, and timed wash. The memory 82 can also be used to store information, such as a database or table, and to store data received from one or more components of the washing machine 10 that can be communicably coupled with the controller 76. The database or table can be used to store the various operating parameters for the one or more cycles of operation, including factory default values for the operating parameters and any adjustments to them by the control system or by user input.

The controller 76 can be operably coupled with one or more components of the washing machine 10 for communicating with and controlling the operation of the component to complete a cycle of operation. For example, the controller 76 can be operably coupled with the motor 54 the valve assembly 62, the pump assembly 66, the dispenser 72, and any other additional components that can be present such as a steam generator and/or a sump heater (not shown) to control the operation of these and other components to implement one or more of the cycles of operation. The controller 76 can also be coupled with one or more sensors 86 provided in one or more of the systems of the washing machine 10 to receive input from the sensors 86, which are known in the art and not shown for simplicity. Communicative control or instruction of any component coupled to the controller 76 can be input at the user interface 80 by a user.

Figure 3:
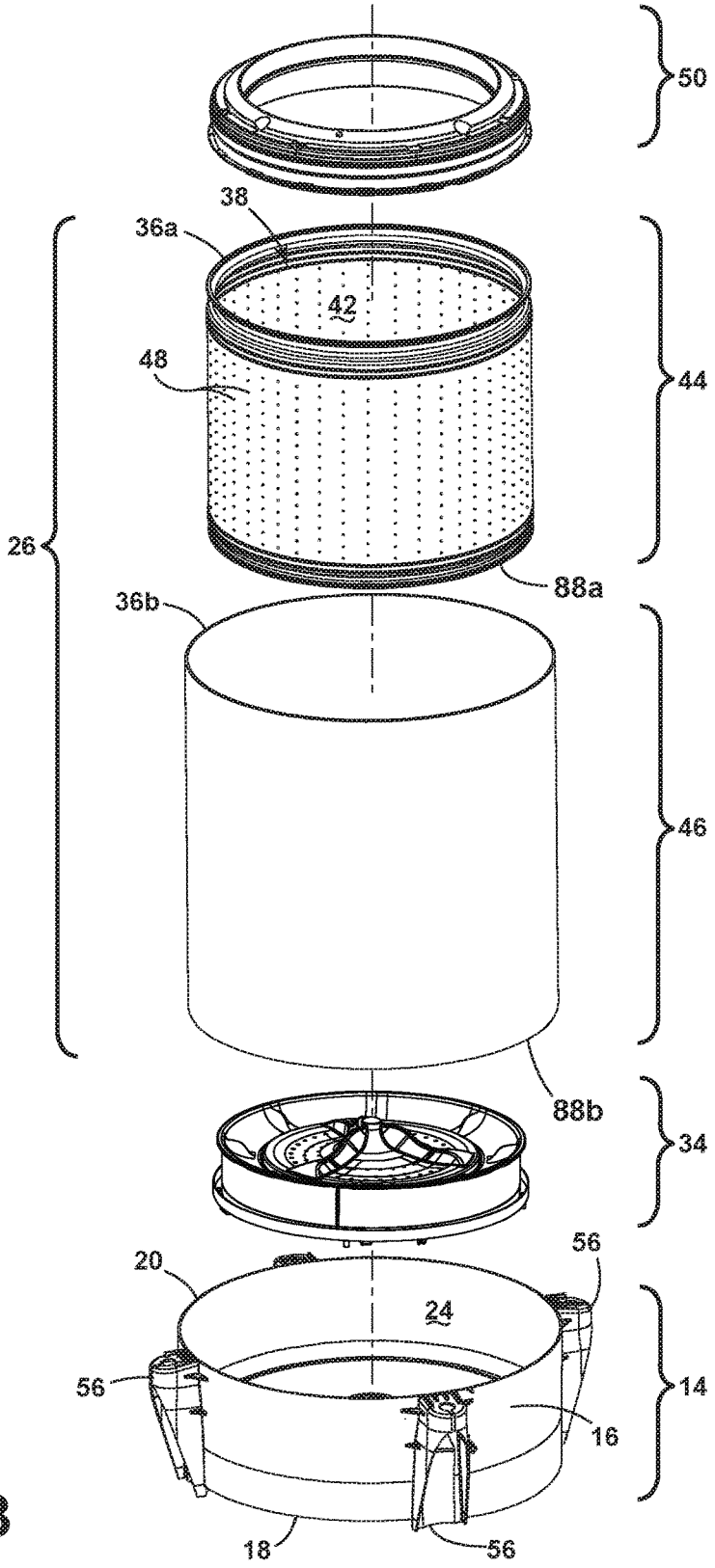
FIG. 3 is an exploded view of the dual basket walls of the double-wall basket and a complementary tub in the form of a mini-tub having a height less than the basket.

Turning to FIG. 3, the components comprising the basket 26 and surrounding elements of FIG. 1 are more easily seen. The basket 26 has dual walls of an inner wall 44 and an outer wall 46, with the inner wall having perforations 48 and being sized to be received within the outer wall 46. Each of the inner and outer walls 44, 46 has an upper or terminal edge 36*a*, 36*b* and a lower edge 88*a*, 88*b*, respectively. The walls 44, 46 are retained between the balancing ring 50 and the basket bottom 34, which can collectively be thought of as a basket assembly, with the inner wall 44 defining an interior that forms the treating chamber 42 and the inner wall terminal edge 36*a* defining the access opening 38. The outer wall 46 can be rigid or non-rigid, and can comprise a curtain. The dual walls are cylindrically shaped, while other shapes are contemplated, and can be made of any suitable material such as, but not limited to, plastic, composite, or polypropylene.

Each wall 44, 46 terminates at the balance ring 50 opposite of the basket bottom 34. At the top of the basket 26, the inner and outer walls 44, 46 can mount to the balance ring 50 at the basket terminal edge 36*a*, 36*b*. At the bottom of the basket 26, the walls 44, 46 mount to the basket bottom 34 at the lower edges 88*a*, 88*b*.

The basket 26 mounts within the tub interior 24, such that a volume of the basket 26 and the basket bottom 34 resides within the tub 14, the tub peripheral wall 16 disposed around at least a portion of the outer wall 46.

Figure 4:
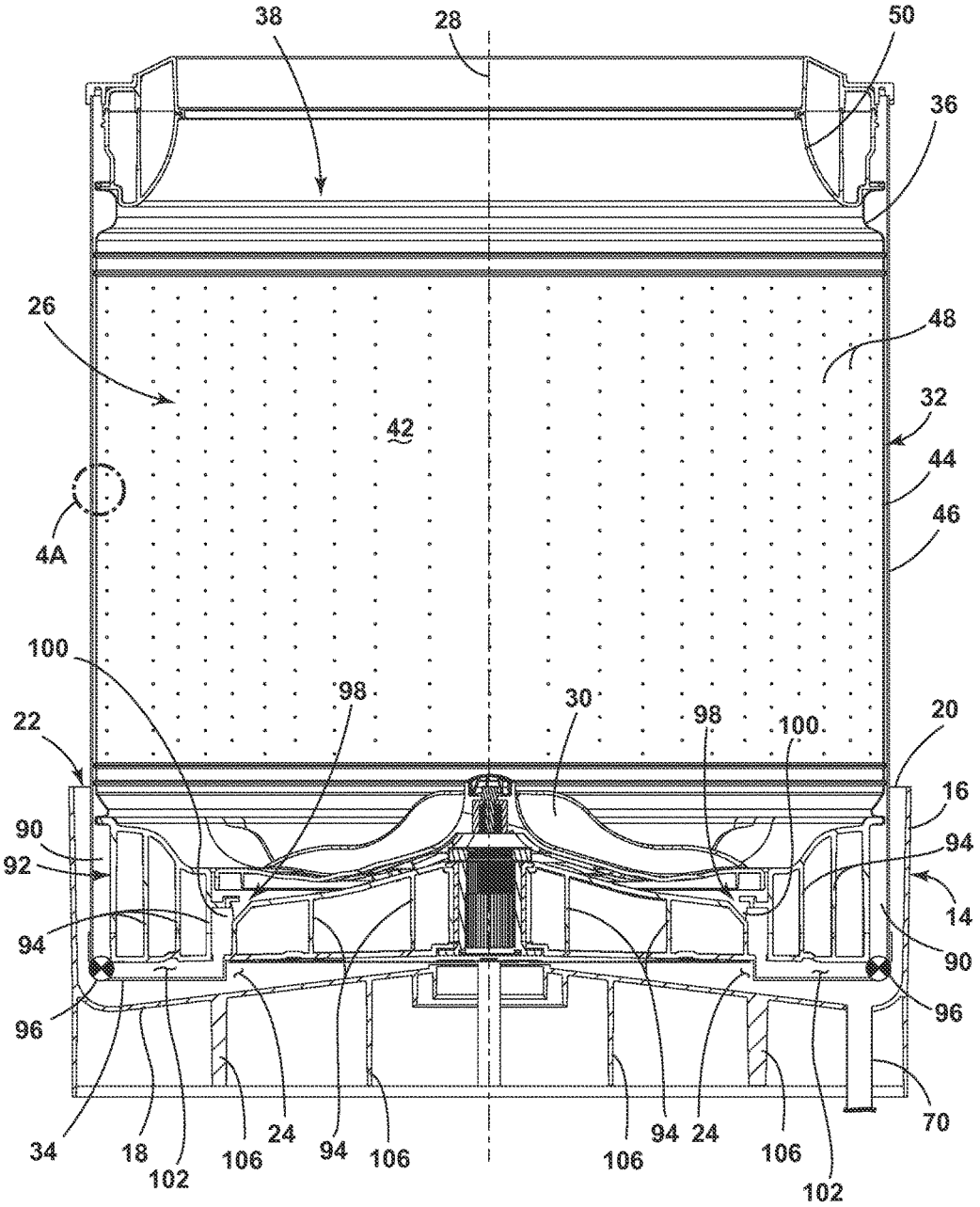
FIG. 4 illustrates a sectional view of an assembly of the double-wall basket and tub of FIG. 3.

Turning to FIG. 4, the inner and outer walls 44, 46 are spaced such that an annular gap or space 40 is defined between them. The inner and outer walls 44, 46 can mount to the balance ring 50 at the basket terminal edge 36*a*, 36*b* and the bottom of the basket 26, the walls 44, 46 mount to the basket bottom 34. The mounting of the walls 44, 46 to the balance ring 50 and basket bottom 34 creates a structural assembly in the form of the basket assembly. The basket 26 is located relative to the tub 14 such that at least a lower portion of the basket 26, including the basket bottom 34 is positioned within the tub interior 24, and at least part of the tub peripheral wall 16 is disposed around at least a portion of the outer wall 46.

The inner and outer walls 44, 46 are spaced from each other to define an interstitial space 40. The space 40 will have a generally annular shape. However, the walls 44, 46 can be coupled to each other at discrete locations, depending on the particular structural requirements, and the discrete couplings can break up the otherwise annular shape of the space 40.

Still referring to FIG. 4, the details of basket bottom 34 will now be described. The basket bottom 34 comprises a basket base structure 92 with a plurality of base walls 94 providing structural integrity to the basket bottom 34. A plurality of drain holes 98 are disposed within the basket bottom 34, and are in fluid communication with one or more basket end drain openings shown as basket drains 100 defined through the basket base structure 92. The basket drains 100, opposite of the drain holes 98, are in fluid communication with one or more drain passages 102 disposed at the bottom of the basket base structure 92. The number of drain passages 102 can be equal to the number of basket drains 100.

While only two drain holes 98 are shown, it should be appreciated that any number of drain holes 98 complementary to any number of basket drains 100 can be disposed within the basket bottom 34. Additional drain holes 98 can be disposed underneath the laundry mover 30 or anywhere else along the basket bottom 34.

The outer edge of the basket base structure 92 defines an inner perimeter of a drain channel 90. The outer wall 46 defines the outer perimeter of the drain channel 90, with the drain channel 90 being in fluid communication with the space 40 between the walls 44, 46. As such, the drain channel 90 is an annular channel extending around the outer perimeter of the basket bottom 34. In variations, depending on the shapes of the basket base structure 92 and the bottom 88*b* of the outer wall 46, the drain channel 90 can be a plurality of shapes, being variable, unique, or rounded in non-limiting examples. Furthermore, the drain channel 90 can be partially filled or blocked by the outer wall 46 or basket base structure 92. In one example, the blockages can direct liquid toward a particular section of the drain channel 90, facilitating drainage through a drain path, which can be defined by the blockages.

A basket valve 96 is disposed at the bottom of the drain channel 90 and at the outer edge of the drain passages 102, defining a junction therebetween. The basket valve 96 can comprise any standard valve, such as a centrifugally-actuated valve, float valve, or any other valve and can operably couple to the controller 76, such that the basket valve 96 can be selectively opened or closed, based upon the cycle of operation. When opened or closed, the basket valve 96 fluidly couples or uncouples, respectively, the drain channel 90 and the drain passages 102 to the tub 14. Furthermore, any number of basket valves 96 can be used. It is contemplated that the basket valves are circumferentially spaced around the washing machine 10. In a further variation, the drain channel 90 and the drain passages 102 can each couple to a separate valve, or can combine into an additional drain space before coupling to the basket valve 96.

Looking now at the tub 14, the tub 14 has a base 104, which is surrounded by the tub peripheral wall 16, and from which extends a plurality of tub base walls 106, providing structural integrity to the tub 14. A drain conduit 70 extends through the base 104 such that the tub interior 24 is in fluid communication with the pump assembly 66. The tub peripheral wall 16 extends upwardly and along the outer wall 46. As illustrated, the upward extent of the tub peripheral wall 16 terminates approximately at the top of the basket bottom 34. The upward extent of the tub peripheral wall 16 is determined by the locations of the basket valves 96 and the volume of liquid that is expected to be retained within the tub 14 during the cycle of operations selected for the washing machine 10. The dual wall structure of the basket 26 does provide the option that the tub need not be used to contain all of the contemplated liquid or to catch all of the liquid during spin as the outer wall 46 performs these functions. Thus, the upward extent of the tub peripheral wall 16 can be much less when compared to a traditional tub.

Figure 4A:
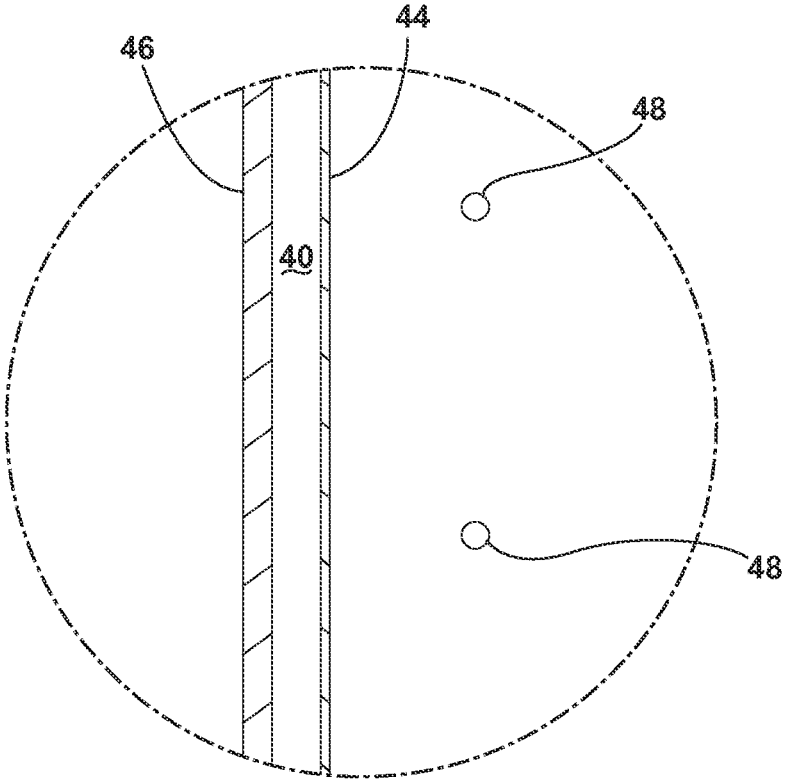
FIG. 4A illustrates a close-up sectional view of the dual walls of the basket and the space therebetween as shown in FIG. 4.

The space 40 between the walls 44, 46 is best seen in FIG. 4A. The space 40 can range between 1.0 and 5.0 millimeters (mm), while a thinner or wider space, as far as 10.0 mm, is contemplated. In previous fabric treating appliances, utilizing a full-sized tub and a single-wall basket, a wider space comprising 25 mm-30 mm is common, while the dual wall basket provides a smaller space between the treating chamber and the outer surface. As traditional tubs are injection molded, which require a draft angle for mold removal, the traditional tubs would have a cone-like shape. The further the upward extent of the traditional tub peripheral wall 16 would necessarily require the tub take up a large volume within the chassis, leaving less volume for the basket, which otherwise reduces basket volume, which otherwise reduces basket capacity. A benefit of the tub 14 is that the much lower vertical extent of the tub peripheral wall 16 leaves a much greater volume for the basket 26, resulting in a greater capacity for the basket 26.

Figure 5:
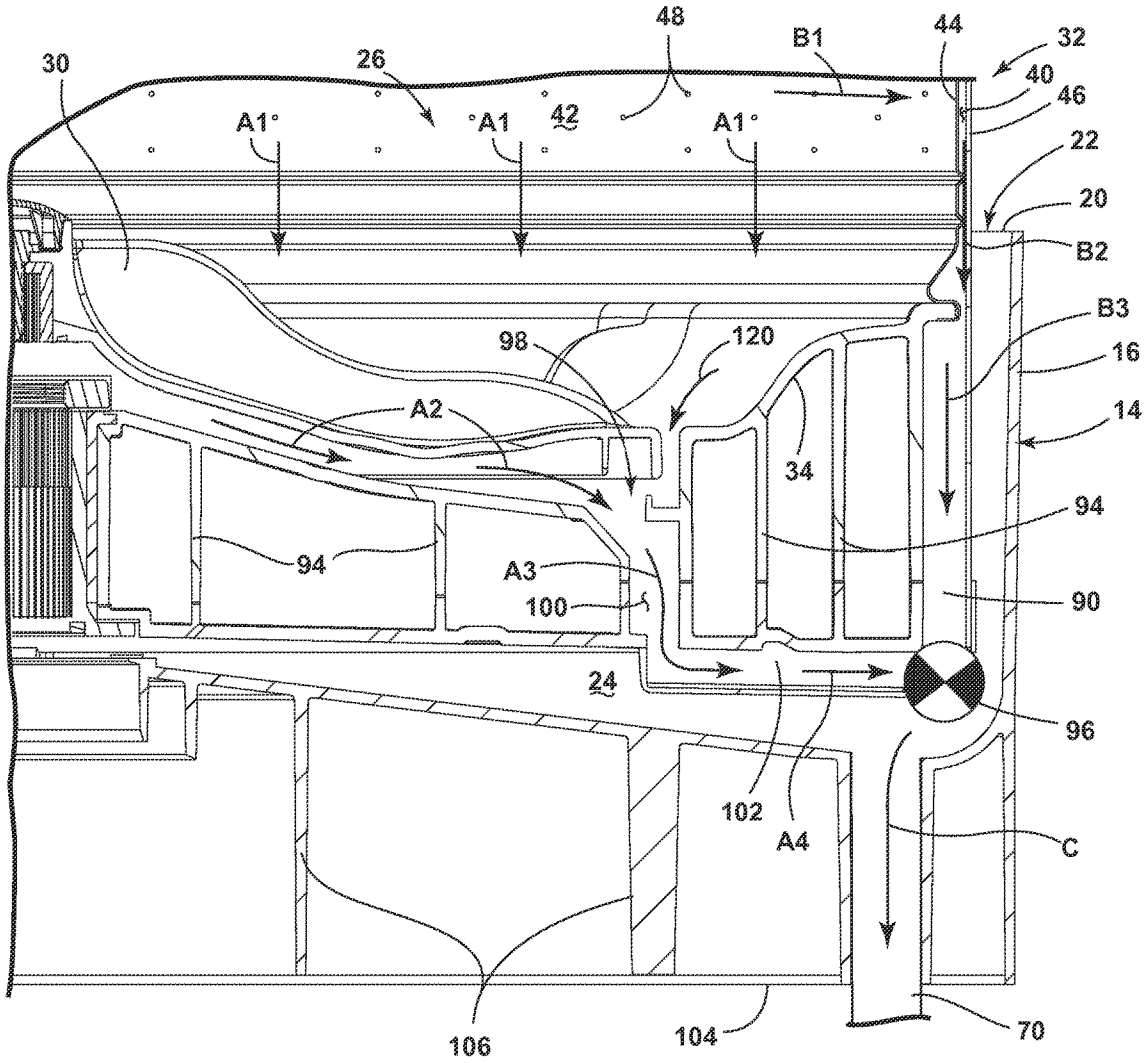
FIG. 5 illustrates a sectional view of a portion of the bottom of the basket and the tub and illustrating the paths for the liquid moving from the treating chamber, between the dual walls, and to the tub.

In FIG. 5, there are illustrated two separate liquid drain paths, A and B, that fluidly couple the treating chamber 42 to the basket valve 96 through the basket bottom 34. The first liquid drain path A, comprises flow paths A1, A2, A3, and A4. At A1, liquid within the treating chamber 42 can flow to the bottom of the treating chamber 42 at the top of the basket bottom 34, and at A2, liquid from the basket bottom 34 flows into the drain hole 98. At A3, liquid from the drain hole 98 flows into the basket drain 100 where the liquid continues into the drain passage 102. At A4, liquid within the drain passage 102 flows to the basket valve 96.

The second liquid drain path B comprises flow paths B1, B2, and B3, which fluidly couple the treating chamber 42 to the basket valve 96 through the basket 26 dual wall structure. As the basket 26 spins, at B1, centrifugal force radially draws liquid within the treating chamber 42, or within the laundry disposed in the treating chamber 42, through the perforations 48 and into the space 40 between the inner wall 44 and outer walls 46. At B2, liquid within the space 40 can flow from the space 40 into the drain channel 90, where at B3, liquid within the drain channel 90 can flow to the basket valve 96.

The basket valve 96 can be selectively opened and closed, permitting liquid to drain from the treating chamber 42 into the tub 14 from either the first or second drain paths, A or B. At a third liquid drain path C, when the basket valve 96 is opened, liquid can drain through the basket valve 96 and into the tub 14, where either an opened pump assembly 66 can drain the liquid or a closed pump assembly 66 can fill the tub 14.

In variations, additional flow paths are contemplated. Variations can include any fluidly coupled path, drain, route, etc. which provides fluid communication between the treating chamber 42 and either the basket valve 96 or the tub 14, or both. One non-limiting example includes a drain path, which fluidly couples the treating chamber to the basket bottom, which couples to the drain channel 90, which then couples to the basket valve 96. As is appreciated, multiple drain paths utilizing a dual wall basket are possible.

Figure 6:
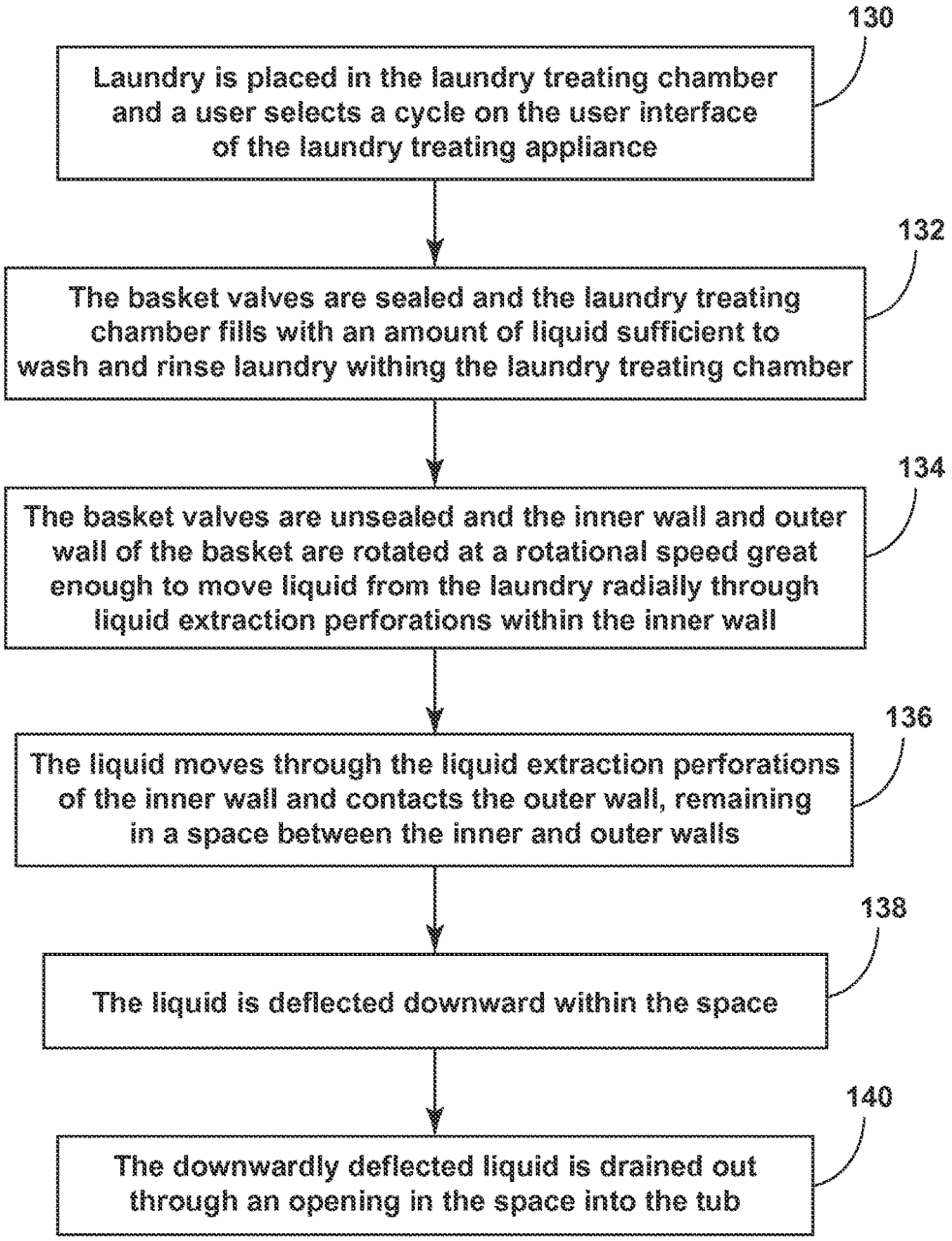
FIG. 6 illustrates a flow chart detailing a method of operation of an appliance according to the invention.

FIG. 6 illustrates one embodiment of a method of operating the washing machine 10. At 130, the user places laundry in the treating chamber 42 for treatment. The user selects a cycle on the user interface 80 and the controller 76 operates the washing machine 10 according a set of controls or operations associated with the selected cycle. At 132, the cycle, such as a wash cycle, begins. The basket valves 96 are closed and liquid flows into the top of the treating chamber 42 from the liquid supply conduit 60 through the liquid supply outlet 64, the liquid being an amount according to the cycle. The liquid can also flow directly into the tub 14 from the liquid supply conduit 60, where the liquid can be pumped into the treating chamber 42 from the recirculation conduit 68. While filling, liquid is permitted to flow into the space between the dual walls 44, 46, as well as the drain channel, the basket drain, and the drain tunnel, while the valve prevents liquid from draining to the tub.

At 134, the basket valves 96 are opened and the liquid is permitted to drain from the treating chamber 42 through the basket valve 96, which can comprise liquid drain paths A or B, or both, or any other drain path fluidly coupling the treating chamber to the basket valve 96. Liquid draining through the basket valve 96 can drain into the tub 14 through liquid drain path C, where the pump assembly 66 can remove the liquid.

Next, a rinse cycle can begin. The basket valve 96 is closed and liquid will again be pumped into the treating chamber 42 from the liquid supply outlet 64 to rinse the laundry therein. After a rinse is complete, the basket valve 96 is opened and the liquid will again be permitted to drain. The liquid will again drain through liquid drain paths A or B, or both, while an amount of residual liquid will remain within the laundry. Liquid flowing out through the opened basket valve 96 will flow through liquid drain path C to the tub 14 fluidly coupled to the pump assembly 66. In order to remove the residual liquid in the laundry, a spin cycle can begin. The spin cycle rotates both the inner and outer walls 44, 46 of the basket 26 at a rotational speed such that the centrifugal force draws residual liquid from the laundry. At, 136, following flow path B1, the residual liquid is drawn radially through the perforations 48 of the inner wall 44 and into the space 40 between the walls 44, 46.

At 138, following flow path B2, the liquid within the space 40 is deflected downward. Gravitational force can assist in the downward movement of the liquid. At 140, now following flow path B3, the downwardly deflected liquid moves from the space 40 and into the drain channel 90. At an opened basket valve 96 and liquid drain path C, the liquid is drained out through basket valve 96 and into the tub 14. Liquid within the tub 14 can drain through the drain conduit 70 where it can be recirculated by the recirculation conduit 68 or removed from the system by the pump assembly 66.

As can be appreciated, an additional spin cycle comprising steps 134, 136, 138, and 140, can be implemented between the wash and the rinse cycle, or at any time during appliance operation to assist in removing residual liquid from the clothing. Furthermore, any combination cycles, comprising but not limited to, wash, rinse, spin, or any other cycle known in the art can be implemented in any combination, where steps 134, 136, 138, and 140 can be intermittently implemented or repeated as necessary to properly treat the laundry within the washing machine 10.

This written description uses examples to disclose the invention, including the best mode, and also to enable any person skilled in the art to practice the invention, including making and using any devices or systems and performing any incorporated methods. The patentable scope of the invention is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A fabric treating appliance for treating laundry according to a cycle of operation, comprising:

a tub having a tub end and a tub peripheral wall extending from the tub end, with the tub end and the tub peripheral wall defining a tub interior, and the tub peripheral wall terminating at a tub terminal edge to define a tub access opening providing access to the tub interior;

a basket having a basket end and a basket peripheral wall extending from the basket end, with the basket end and the basket peripheral wall defining a basket interior forming at least part of a laundry treating chamber, the basket peripheral wall defining a basket access opening providing access to the basket interior, and at least a portion of the basket extends into the tub interior;

the basket end being provided with a plurality of drain holes in fluid communication with at least one drain passage in fluid communication with a basket valve configured to selectively drain liquid into the tub;

a balance ring positioned above the basket; and a motor operably coupled to the basket and rotating the basket relative to the tub about a basket axis of rotation;

wherein the basket peripheral wall comprises an inner wall and an outer wall defining a space there between, wherein the inner and outer wall are parallel across a length of the laundry treating chamber and wherein both the inner and outer wall mount to and terminate at the balance ring, the inner wall comprising a plurality of liquid extraction perforations, with at least some of the liquid extraction perforations located exterior of the tub interior, the outer wall being imperforate opposite the exterior liquid extraction perforations, and the outer wall having a drain channel in fluid communication with the basket valve such that liquid can only be expelled from the basket through the basket valve;

whereby liquid can be extracted from laundry within the basket interior by one of rotating the basket to an extraction speed where the liquid passes through the liquid extraction perforations, contacts the outer wall, and flows through the drain channel to the basket valve and by passing liquid through the drain holes in the basket end through the at least one drain passage and to the basket valve.

2. The fabric treating appliance of claim 1 wherein the space between the inner wall and the outer wall is in fluid communication with the drain channel.

3. The fabric treating appliance of claim 2 wherein the drain channel is located within the tub interior.

4. The fabric treating appliance of claim 1 wherein the outer wall is rigid.

5. The fabric treating appliance of claim 1 wherein the outer wall is non-rigid.

6. The fabric treating appliance of claim 1 wherein the valve comprises a centrifugally-actuated valve.

7. The fabric treating appliance of claim 1 further comprising a liquid supply providing liquid to the basket interior.

8. The fabric treating appliance of claim 1 wherein the basket axis of rotation is vertical.

9. A fabric treating appliance for treating laundry according to a cycle of operation, comprising:

a vertically-oriented tub defining a tub interior and terminating in a tub terminal edge to define a tub access opening providing access to the tub interior; and a vertically-oriented basket having an end with a plurality of drain holes in fluid communication with at least one drain passage in fluid communication with a basket valve configured to selectively drain liquid into the tub; the basket further having a peripheral wall comprising an inner wall and an outer wall defining a space there between wherein the inner and outer wall are parallel across a length of the laundry treating chamber and wherein both the inner wall and the outer wall mount to and terminate at a balance ring, the inner wall comprising a plurality of liquid extraction perforations, with at least some of the liquid extraction perforations located exterior of the tub interior, the outer wall being imperforate opposite the exterior liquid extraction perforations, and the outer wall having a drain channel in fluid communication with the basket valve such that liquid can only be expelled from the basket through the basket valve;

whereby liquid can be extracted from laundry within the basket interior by one of rotating the basket about a vertical axis to an extraction speed where the liquid radially passes through the liquid extraction perforations, contacts the outer wall, and flows through the drain channel and basket valve and by passing liquid through the drain holes in the basket end through the at least one drain passage and to the basket valve.

10. The fabric treating appliance of claim 9 wherein the space between the inner wall and the outer wall is in fluid communication with the drain channel.

11. The fabric treating appliance of claim 9 wherein the outer wall is rigid.

12. The fabric treating appliance of claim 9 wherein the outer wall is non-rigid.

* * * * *